US010422272B2

(12) United States Patent
Kessler

(10) Patent No.: US 10,422,272 B2
(45) Date of Patent: Sep. 24, 2019

(54) COMPACT PORTED CYLINDER CONSTRUCTION FOR AN OPPOSED-PISTON ENGINE

(71) Applicant: ACHATES POWER, INC., San Diego, CA (US)

(72) Inventor: John M. Kessler, Oceanside, CA (US)

(73) Assignee: ACHATES POWER, INC., San Diego, CA (US)

( * ) Notice: Subject to any disclaimer, the term of this patent is extended or adjusted under 35 U.S.C. 154(b) by 199 days.

(21) Appl. No.: 14/932,002

(22) Filed: Nov. 4, 2015

(65) Prior Publication Data

US 2017/0122185 A1 May 4, 2017

(51) Int. Cl.

| | |
|---|---|
| ***F02B 25/08*** | (2006.01) |
| ***F02B 75/28*** | (2006.01) |
| ***F02F 1/18*** | (2006.01) |
| ***F02F 1/42*** | (2006.01) |
| ***F01B 7/14*** | (2006.01) |
| ***F02B 25/00*** | (2006.01) |
| ***F01B 7/02*** | (2006.01) |
| ***F02B 75/02*** | (2006.01) |

(52) U.S. Cl.

CPC ..... *F02B 25/08* (2013.01); *F01B 7/14* (2013.01); *F02B 75/282* (2013.01); *F02F 1/18* (2013.01); *F02F 1/4285* (2013.01); *F01B 7/02* (2013.01); *F02B 25/00* (2013.01); *F02B 75/28* (2013.01); *F02B 2075/025* (2013.01)

(58) Field of Classification Search

CPC .... F02B 25/00; F02B 25/08; F02B 2075/025; F02B 75/28; F01B 7/02

USPC ..... 123/51 BD

See application file for complete search history.

(56) References Cited

U.S. PATENT DOCUMENTS

| | | | | |
|---|---|---|---|---|
| 1,808,664 | A | 6/1931 | Koschka | 123/41.35 |
| 2,170,020 | A | 8/1939 | Gerlach | 123/51 BD |
| 2,393,085 | A | 1/1946 | Wuehr | 123/51 BD |
| 2,624,328 | A | 1/1953 | Grinham et al. | 123/193.4 |
| 2,925,073 | A | 2/1960 | Millar | 123/46 R |
| 3,866,581 | A | 2/1975 | Herbert | 123/51 B |

(Continued)

FOREIGN PATENT DOCUMENTS

| | | |
|---|---|---|
| DE | 4335515 A1 | 4/1995 |
| EP | 1124052 B1 | 3/2007 |

(Continued)

OTHER PUBLICATIONS

International Search Report and Written Opinion for PCT application PCT/US2016/058777, dated Jan. 12, 2017.

(Continued)

*Primary Examiner* — Jacob M Amick
*Assistant Examiner* — Charles Brauch
(74) *Attorney, Agent, or Firm* — Terrance A. Meador; Julie J. Muyco

(57) ABSTRACT

A compact construction for an opposed-piston engine includes a cylinder liner with longitudinally-spaced exhaust and intake ports in which the exhaust port has inner and outer edges presenting a port height that causes the exhaust port to be fully open before a piston associated with the exhaust port reaches bottom dead center during an expansion stroke and the end surface of the associated piston to be spaced outwardly of the outer edge when the piston is at bottom dead center.

3 Claims, 4 Drawing Sheets

(56) References Cited

U.S. PATENT DOCUMENTS

| | | | | |
|---|---|---|---|---|
| 4,480,597 | A * | 11/1984 | Noguchi | F02B 25/08 123/51 BA |
| 5,213,067 | A | 5/1993 | Kramer | 123/51 BA |
| 6,953,010 | B1 | 10/2005 | Hofbauer | 123/46 |
| 7,438,038 | B2 | 10/2008 | Azevedo et al. | 123/193.2 |
| 8,413,632 | B2 | 4/2013 | Sand | 123/193.2 |
| 8,935,998 | B1 | 1/2015 | Tebbe | |
| 9,068,498 | B2 | 6/2015 | Callahan | |
| 2005/0103287 | A1 * | 5/2005 | Hofbauer | F02B 1/12 123/46 E |
| 2010/0024759 | A1 * | 2/2010 | Dobransky | F16J 1/08 123/193.6 |
| 2012/0186561 | A1 | 7/2012 | Bethel et al. | 123/51 R |
| 2012/0306207 | A1 * | 12/2012 | Gudgeon | F01D 1/026 290/52 |
| 2013/0199503 | A1 | 8/2013 | Callahan et al. | 123/51 R |
| 2014/0216425 | A1 | 8/2014 | Callahan | |

FOREIGN PATENT DOCUMENTS

| | | | |
|---|---|---|---|
| GB | 1041852 | A | 9/1966 |
| WO | WO 2009/061873 | A2 | 5/2009 |
| WO | WO 2015/038425 | A1 | 3/2015 |

OTHER PUBLICATIONS

International Search Report and Written Opinion for PCT application PCT/US2014/054235, dated Feb. 3, 2015.

Pirault, J and Flint, M. *Opposed Piston Engines: Evolution, Use, and Future Applications*, SAE International, Warrendale Penna., Oct. 2009, Section 3.2: Junkers Jumo 2005; pp. 55-106.

Pirault, J and Flint, M. *Opposed Piston Engines: Evolution, Use, and Future . Applications*, SAE International, Warrendale Penna., Oct. 2009, Section 3.3: Junkers Jumo 2007B2; pp. 102-119.

* cited by examiner

COMPACT PORTED CYLINDER CONSTRUCTION FOR AN OPPOSED-PISTON ENGINE

FIELD

The field of the invention relates to compact ported cylinder constructions for opposed-piston engines.

BACKGROUND

A cylinder for an internal combustion engine may be constructed by boring an engine block or by inserting a liner (also called a sleeve) into a cylindrical space formed in an engine block. The following description presumes a cylinder with a liner construction; however the underlying principles apply as well to a bored construction.

A cylinder liner of an opposed-piston engine has a cylindrical inner wall that provides a bore with a longitudinal axis. Intake and exhaust ports are formed in the liner wall and located on respective sides of a central portion of the liner. Each port includes a plurality of port openings disposed in an annular array along a respective circumference of the liner, and adjacent openings are separated by solid portions of the liner wall called "bridges" or "bars". (In some descriptions, each opening is referred to as a "port"; however, the construction of a circumferential array of such "ports" is no different than the port constructions described herein.) So constructed, the liner forms a "ported cylinder" when received in an opposed-piston engine.

When considering packaging in many applications, the length of a cylinder is one of the primary challenges of an opposed-piston engine. This is because there are two pistons coaxially disposed for opposed sliding motion in the bore between a top dead center location (hereinafter, "TDC") and a bottom dead center location (hereinafter, "BDC"). Thus, the cylinder must be long enough to accommodate at least twice the length of each piston; in other words, the length of the cylinder is generally ≥4× the piston length. Any incremental reduction in these fundamental length limitations is therefore desirable when reduction in the engine profile is pursued.

Commonly-owned U.S. Pat. No. 8,935,998 describes a compact cylinder liner construction for an opposed-piston engine. As per a typical opposed-piston application including a ported liner, each piston in the cylinder is associated with a respective one of the two ports. In most applications, each piston has an upper ring pack adjacent the top land of the piston crown for containing combustion, and a lower ring pack in its lower skirt portion with which lubricant (engine oil) is scraped from the bore. Generally, the piston is somewhat longer than the longitudinal distance between the ring packs. When the piston is at TDC, the oil control (lower) ring pack is positioned near the outer edge of the port with which the piston is associated. The '998 patent describes a transition pattern in the bore diameter that permits an oil control ring pack to more closely approach the outer edge of the port when the piston is at TDC. This allows the length of the piston to be shortened, thereby leading to a reduction in the required cylinder length.

It is known that two-stroke cycle, opposed-piston engines provide superior power densities and brake thermal efficiencies as compared to their four-stroke counterparts. However, the length of the cylinder places a hurdle in the path of broad acceptance of opposed-piston technologies, especially in transportation applications where engine compartment space is limited. Accordingly, further reductions in cylinder length will extend the range of applications of opposed-piston technology.

SUMMARY

The invention provides for a compact, ported cylinder for an opposed-piston engine in which the exhaust port is of such a length as to cause it to be fully open before the piston associated with it reaches BDC during an expansion stroke. In this regard the height of the exhaust port is considered to be truncated with respect to a prior art exhaust port in which the port is only fully open when the associated piston reaches BDC.

The liner bore has a central portion where opposed pistons reach respective top dead center locations to form a combustion chamber. The central portion of the bore transitions to respective end portions that extend from the intake and exhaust ports to respective open ends of the liner. A respective piston bottom dead center location is in each end portion. An end portion also includes the bridges and openings of a port and the remaining liner portion from the port to the nearest open end of the liner.

Each port has inner and outer edges that are spaced apart in a longitudinal direction of the liner such that the inner edge is nearest an injector plane orthogonal to the longitudinal axis of the bore and the outer edge is furthest from the injector plane. The outer edge of the port is disposed in the bore at a location spaced inwardly of the liner, in the direction of the injector plane, from the top of the associated piston when at BDC. As a consequence, the oil control ring pack of the associated piston can be located nearer the upper ring pack, thereby reducing the length of the piston, which, in turn enables reduction of the length of the cylinder.

DETAILED DESCRIPTION OF THE PREFERRED EMBODIMENTS

Figure 1A:
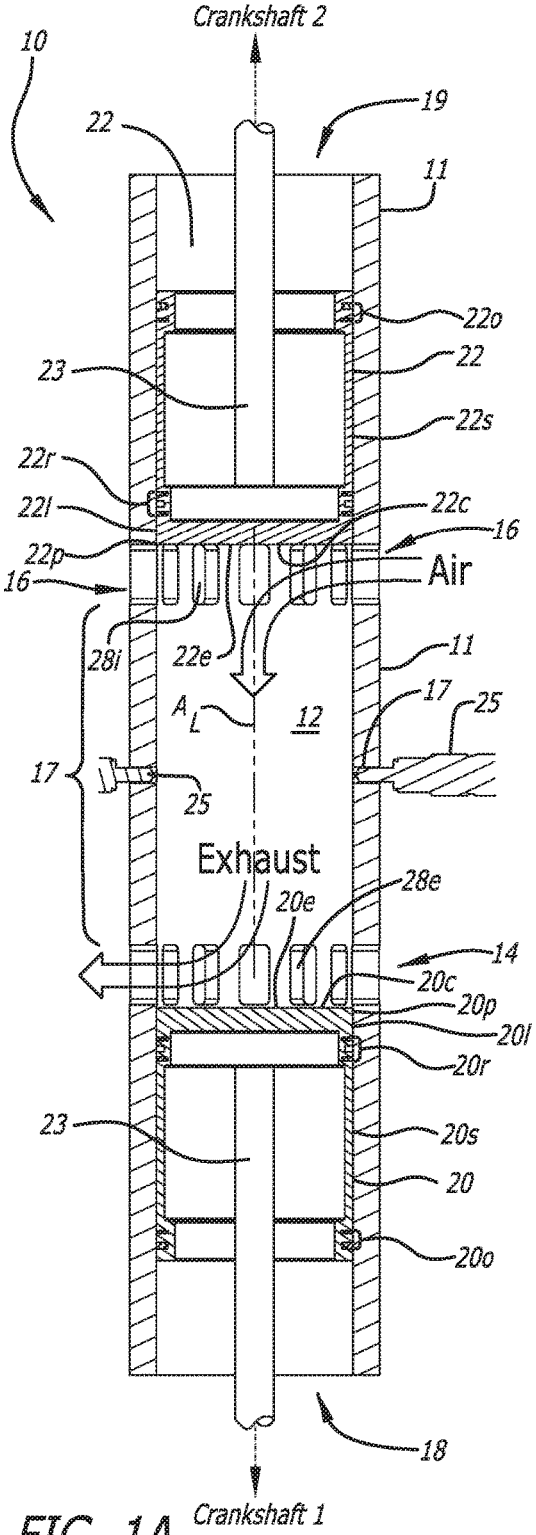
FIG. 1A (Prior Art)
FIG. 1A is a side sectional, partially schematic drawing of a cylinder in an opposed-piston engine with opposed pistons near respective bottom dead center ("BDC") locations, and is appropriately labeled "Prior Art"
Figure 1B:
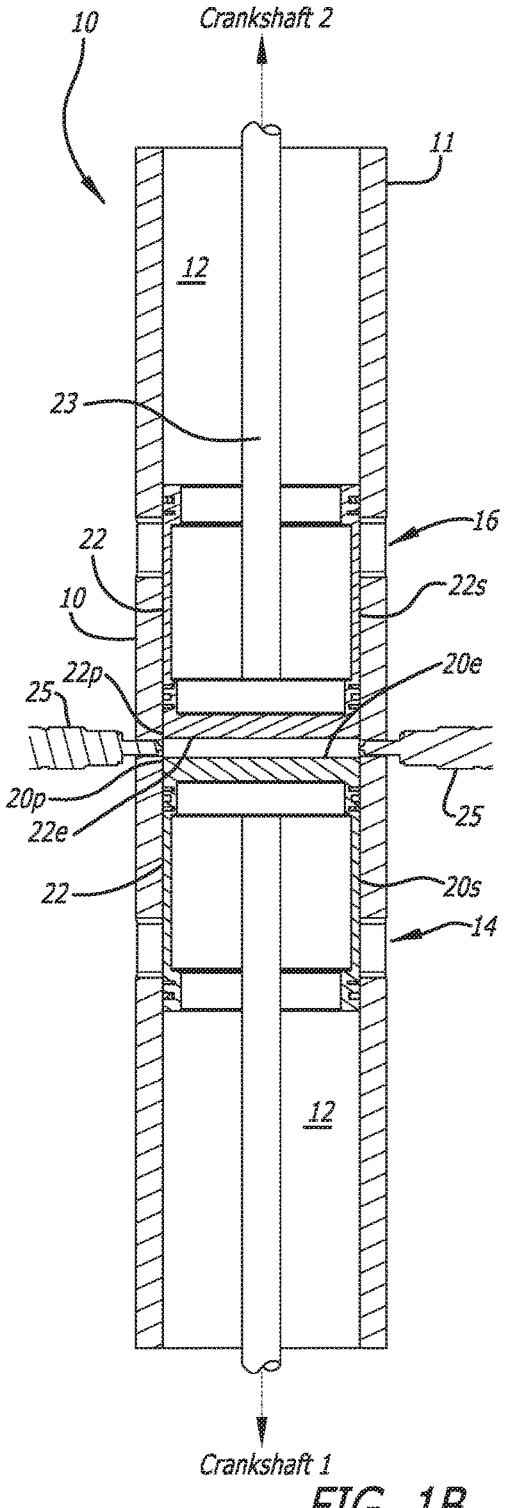
FIG. 1B (Prior Art)
FIG. 1B is a side sectional partially schematic drawing of a cylinder in an opposed-piston engine with opposed pistons near respective top dead center ("TDC") locations, and is appropriately labeled "Prior Art".

FIGS. 1A and 1B show cross-sectional views of an opposed-piston engine 10 including one or more ported cylinders represented by the liner 11. Although these figures show the cylinder disposed vertically, this is not intended to be limiting. In fact, depending on the application, the orientation may vary between vertical and horizontal. The liner 11 has a cylindrical inner wall that provides a bore 12 with a longitudinal axis $A_L$. Exhaust and intake ports 14 and 16 are formed in the liner wall and located on respective sides of a liner central portion 17. The exhaust and intake ports 14 and 16 are located near respective open exhaust and intake ends 18 and 19 of the liner 11. Pistons 20 and 22 are placed in opposition in the bore; during engine operation, the pistons move in opposition in the bore 12, reciprocating between TDC and BDC. Each of the pistons is equipped with a connecting rod 23 that couples it to a respective one of two crankshafts. The pistons 20 and 22 are respectively associated with the exhaust port 14 and the intake port 16, and their movements in the bore 12 control the operations of these ports. In FIG. 1A, the pistons 20 and 22 are located at, or near their respective BDC locations in the bore 12. In this figure both ports 14 and 16 are fully open; that is to say, they are not obstructed by the pistons 20 and 22. FIG. 1B shows the pistons located at, or near, their respective TDC positions. In a two-stroke cycle operation the pistons 20 and 22 slide in the bore 12 from BDC to TDC in a compression stroke and return from TDC to BDC in an expansion stroke.

Each piston has a crown 20*c*, 22*c* and a skirt 20*s*, 22*s*. The crown has an upper land 20*l*, 22*l* and a circular peripheral edge 20*p*, 22*p* where the upper land meets the end surface 20*e*, 22*e* of the crown. Below the upper land, a series of circumferential ring grooves is provided in the piston sidewall to receive a compression ring pack 20*r*, 22*r*. The compression ring pack includes at least two piston rings; in some instances, the topmost piston ring (the ring nearest the upper land) is a compression ring which seals the combustion chamber. A series of circumferential grooves in the lower portion of the piston skirt receive an oil control ring pack 20*o*, 22*o*. The oil control ring pack includes at least two piston rings; in some instances, the topmost ring (the ring nearest the upper ring pack) is an oil scraper ring, which maintains a consistent thickness of oil between an open end and a port. The exhaust and intake ports 14 and 16 of the cylinder liner 11 are similarly constructed. In this regard, each port includes at least one annular array of openings 28*e*, 28*i* along a respective circumference of the cylinder 11. For convenience, the port openings are shown with identical shapes, but it is frequently the case that the exhaust port openings will be of a different shape, and larger, than the intake port openings.

In a two-stroke cycle operation of the opposed-piston engine 10 presume that the piston end surfaces 20*e* and 22*e* are in the central portion of the cylinder liner 11, near TDC, at the moment of combustion, as shown in FIG. 1B. When combustion occurs, the pistons 20 and 22 are driven outward during an expansion stroke towards their BDC positions in respective exhaust and intake end sections on opposite sides of the central portion.

In some cases, the pistons may be out of phase with one another. For example, crankshaft 1 to which the exhaust piston 20 is coupled (the "exhaust crank") may lead crankshaft 2 to which the intake piston 22 is coupled (the "intake crank"), thereby causing the exhaust piston 20 to lead the intake piston 22, in which case the exhaust port 14 will be opened (and closed) before the intake port 16. As the exhaust piston 20 traverses the exhaust port 14, moving toward BDC, combustion gases will start to exit the exhaust port. The intake port 16 will then begin to open as the intake piston 22 traverses it toward BDC. Pressurized fresh air ("charge air") will enter the cylinder bore 12 and begin to scavenge any remaining combustion gases out of the exhaust port 14. As the pistons 20 and 22 travel through their respective BDC positions and start to return to TDC in a compression stroke, charge air continues to flow into the bore until the exhaust port 14 is closed by the exhaust piston 20 and the intake port 16 is closed by the intake piston 22. At this point, as the exhaust and intake pistons 20 and 22 continue sliding towards TDC the charge air trapped in the cylinder bore 12 by closure of the ports 14 and 16 is increasingly compressed, which raises its temperature. When the end surfaces 20*e* and 22*e* of the two pistons are adjacent as per FIG. 1B, fuel is injected into the heated, compressed air through one or more injectors 25 and the air/fuel mixture ignites, initiating an expansion stroke.

Figure 2A:
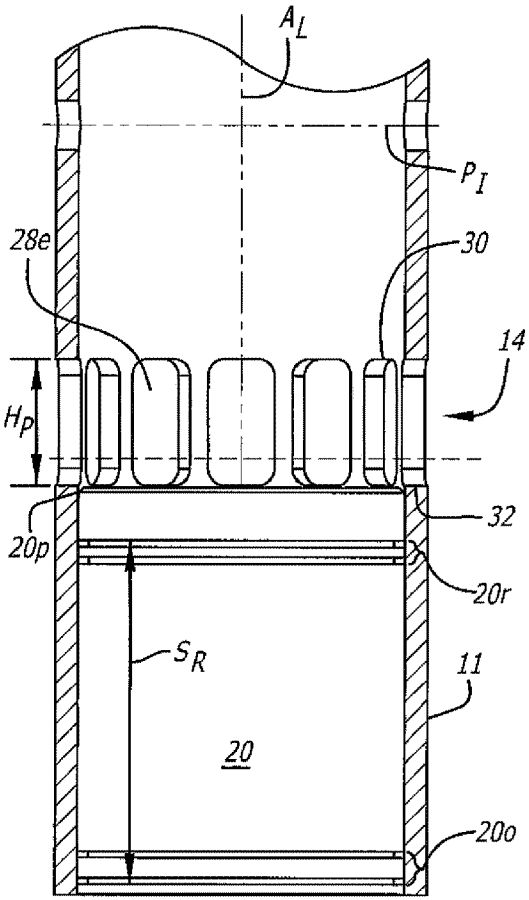
FIG. 2A (Prior Art)
FIG. 2A is an enlarged sectional view showing an exhaust end portion of the cylinder liner of FIGS. 1A and 1B, with an associated piston at a bottom dead center (BDC) location and is appropriately labeled "Prior Art"
Figure 2B:
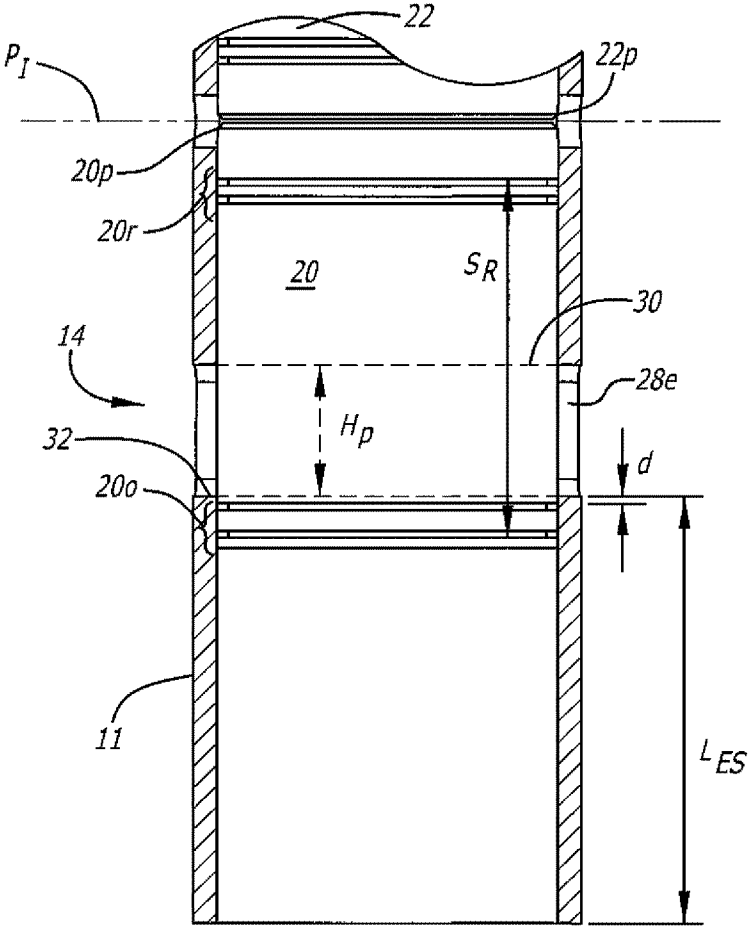
FIG. 2B (Prior Art)
FIG. 2B is an enlarged sectional view showing the exhaust end portion of the cylinder liner of FIGS. 1A and 1B, with the associated piston at a top dead center (TDC) location and is appropriately labeled "Prior Art".

Referring now to FIGS. 2A and 2B, the piston 20 is shown in a prior art, "baseline", relationship with respect to the liner 11. In this regard, an injector plane $P_I$ orthogonal to the longitudinal axis $A_L$ represents the position along the axis $A_L$ where injector centerlines are positioned. First edges of the annular array of openings 28*e* present an inner edge 30 of the exhaust port 14, and second edges of the openings 28*e* present an outer edge 32 of the exhaust port 14, such that the port openings 28*e* are contained between the inner and outer edges. As per the figures, the inner edge 30 is nearer the injector plane $P_I$ than the outer edge 32. The inner edge 30 and an outer edge 32 present a longitudinal separation (distance) therebetween which is denoted as a port height $H_P$. The inner edge of the ring pack 20*r* and the outer edge of the oil control pack 20*o* present a longitudinal separation (distance) therebetween which is denoted as a ring separation distance $S_R$.

As best seen in FIG. 2A, when the piston 20 is at BDC, the peripheral edge 20*p* is adjacent the outer edge 32 of the of the exhaust port 14. In this regard, the outer edge 32 may be said to be located at BDC. At this point, the oil control pack 20*o* is fully contained in the bore (as it must be in order for the rings to be retained in their grooves), adjacent the open exhaust end 18. Thus the exhaust port 14 is fully open only when the piston 20 reaches BDC.

As best seen in FIG. 2B, when the piston 20 is at TDC, the peripheral edge 20*p* is near the injector plane. At this point, the inner edge of the oil control pack 20*o* is separated by a small distance d from the outer edge 32 of the exhaust port 14, on the outboard side of the edge 32, as it must be in order to maintain the seal between the exhaust port 14 and the crankcase when the piston 20 covers the port.

As best seen in FIGS. 2A and 2B, it should be evident that the ring separation distance $S_R$ strongly influences the length of the piston 20, which, in turn, influences the length of the liner 11. One way to reduce $S_R$ is to reduce the distance swept by the oil control ring pack 20*o* each cycle of engine operation. However, in the case where reduction of engine height is sought while preserving stroke length and compression ratio, it is difficult to lower $S_R$ with a liner construction in which exhaust port height $H_P$ remains unchanged. Further, in order to preserve piston stroke and compression ratio, the inner edge 30 of the exhaust port 14 must remain in the baseline location of FIGS. 2A and 2B. According to the invention, desirable reductions are achieved by moving the outer edge 32 of the exhaust port 14 inboard, toward TDC, such that the strokes of the oil ring pack 20*o* can be positioned inboard, as well. From there a cascade of parts can shorten: piston, liner, rod, crank-injector plane distance, and ultimately the overall engine.

Presume now that the construction of the cylinder liner of FIGS. 2A and 2B is modified by reducing the port height $H_p$ without changing piston stroke and compression ratio. In this regard, a novel cylinder construction is illustrated by the example of exhaust port height reduction, although this is not intended to so limit the scope of the invention. Exhaust port height reduction is achieved by forming the port openings 28*e* in FIGS. 3A-3C with a smaller height than in FIGS. 2A and 2B, with the inner edge 30 of the exhaust port 14 remaining at the same distance from the injector plane as in FIG. 2A. In this case, port height reduction is achieved by repositioning the outer edge 32 inboard, in the direction of the injector plane $P_I$, thereby shortening the longitudinal distance between the inner and outer edges 30 and 32, and providing a reduced height $H_P'$ of the exhaust port. This construction of the cylinder liner permits a commensurate compact construction of the piston 20 in which the oil ring pack 20*o* is repositioned longitudinally in the direction of the compression ring pack 20*c*, with the benefit of providing a reduced ring separation distance $S_R'$. Therefore, as a consequence of reducing the height of the exhaust port, both the piston 20 and the cylinder liner 11 can be shortened, thereby providing a more compact cylinder construction when compared with the prior art shown in FIGS. 2A and 2B.

The compact cylinder liner construction according to the invention can be further understood with reference to the positional relationships between the cylinder and piston during engine operation, while the piston moves between TDC and BDC. In this regard, with reference to FIG. 3A, during an expansion stroke, the peripheral edge 20*p* of the piston reaches the outer edge 32 so as to fully open the exhaust port 14 before the piston 20 reaches its BDC location. Then, when the first piston reaches BDC, the peripheral edge 20*p* of the piston 20 is spaced outboard of the exhaust port, in the direction of the open exhaust end 18.

Figure 3B:
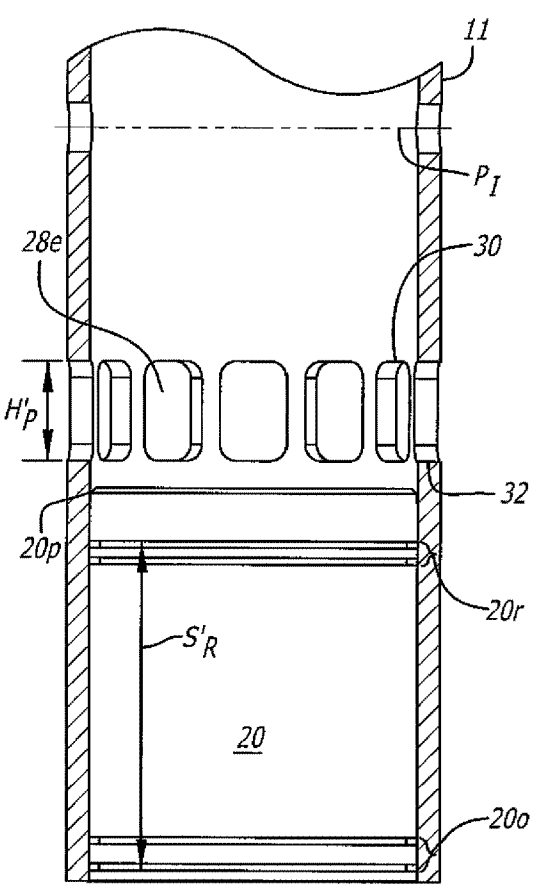
FIG. 3B is an enlarged sectional view showing the exhaust end portion of the cylinder liner constructed according to the invention, with the associated piston at BDC.
Figure 3A:
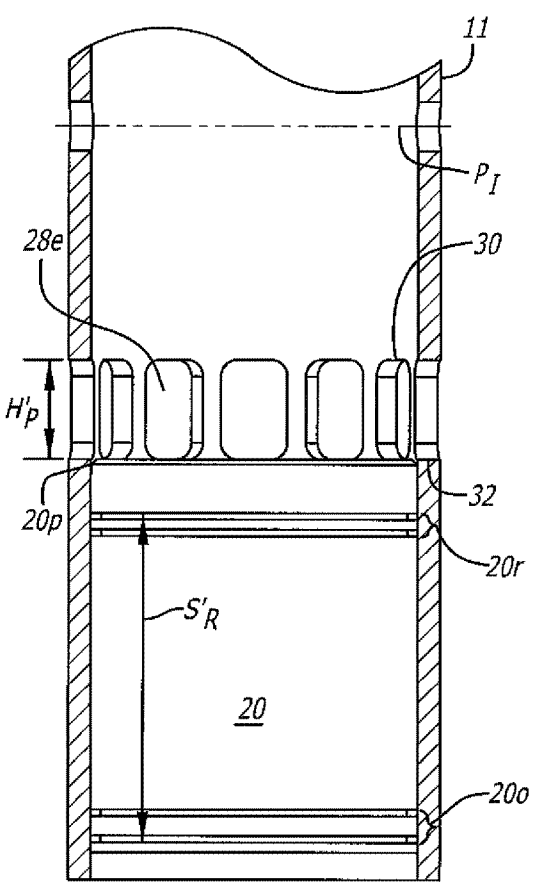
FIG. 3A is an enlarged sectional view showing the exhaust end portion of the cylinder liner constructed according to the invention, in which the exhaust port is fully open before the associated piston reaches BDC.
Figure 3C:
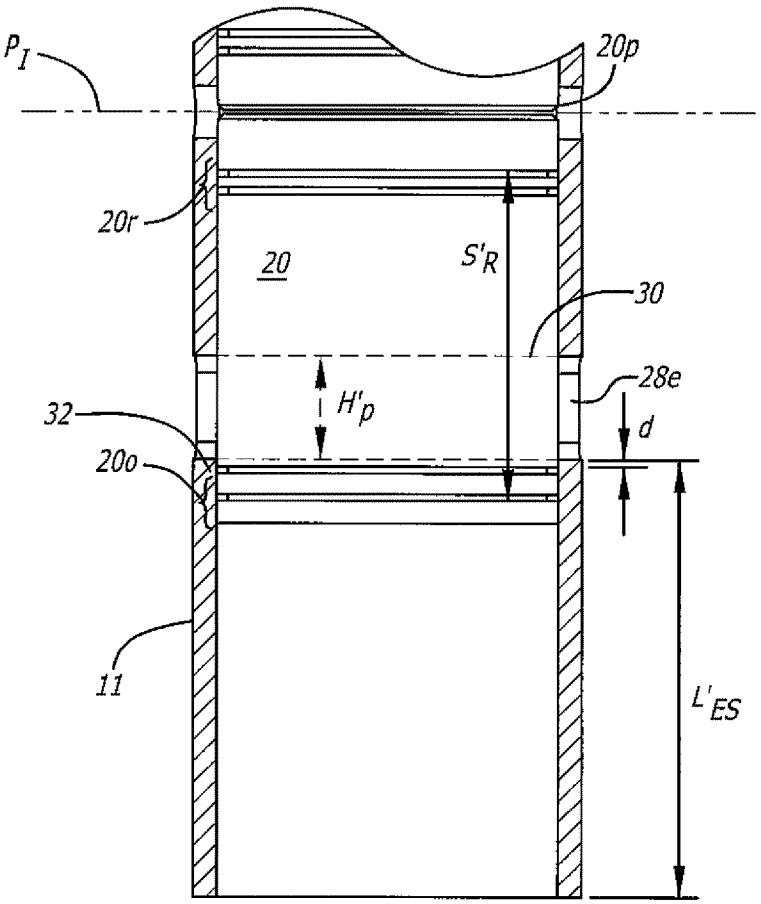
FIG. 3C is an enlarged sectional view showing the exhaust end portion of the cylinder liner constructed according to the invention, with the associated piston at TDC.

As per FIG. 3C, when the piston 20 is at TDC, the resulting port height $H_P'$ is such that the exhaust port 14 is between the compression (upper) ring pack 20*c* and the oil control (lower) ring pack 20*o* of the piston 20, with the oil control ring pack 20*o* is separated by the same distance d from the outer edge 32 of the exhaust port 14 as in FIG. 2B.

Reduction of the length of the liner may be seen in FIGS. 2A and 3B, where shortening $H_P$ to $H_P'$ enables shortening of $S_R$ to $S_R'$, which, in turn, enables the length of the exhaust end section $L_{ES}$ of the liner to be shortened to $L_{ES}'$. This in turn enables a commensurate reduction in the height of the opposed piston engine, thereby taking full advantage of the compact ported cylinder construction of the invention.

Although compact cylinder construction according to the invention is illustrated by reduction of exhaust port height, this is not meant to exclude the achievement of the same goals by reducing intake port height in the same manner or by reducing both exhaust and intake port height as disclosed.

Figure 4:
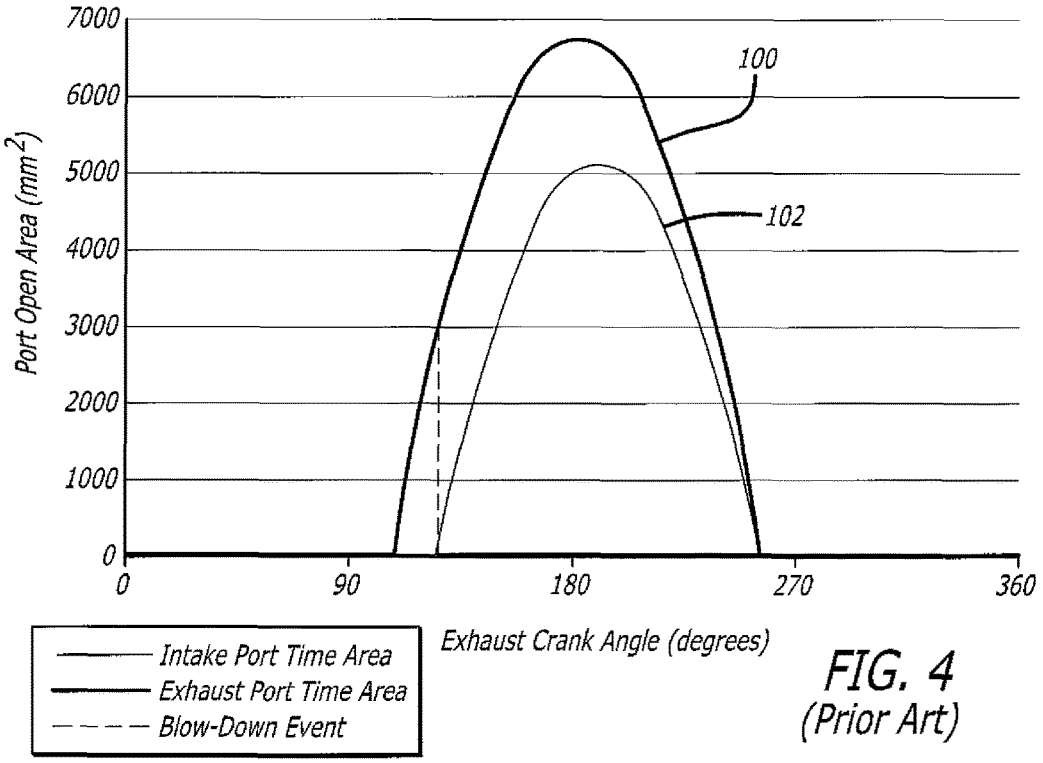
FIG. 4 (Prior Art)
FIG. 4 is a graph showing a time plot of an angle of rotation of an exhaust crank versus the total area of the exhaust port that is open during one complete cycle of engine operation, and is appropriately labeled "Prior Art".
Figure 5:
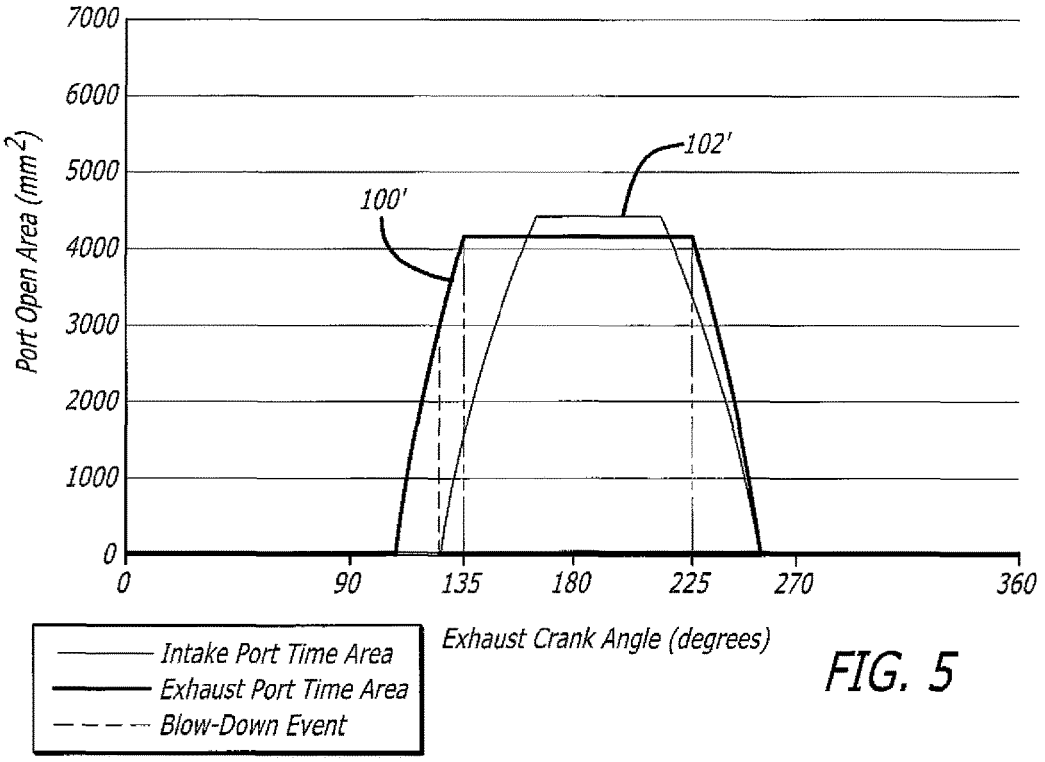
FIG. 5 is a graph showing a time plot of the angle of rotation of an exhaust crank versus the total area of an exhaust port constructed according to the invention that is open during one complete cycle of engine operation.

FIG. 4 relates to the baseline port geometry of FIGS. 2A and 2B. This figure is a time plot of the angle of rotation (the "crank angle") of the exhaust crank versus the total area of the exhaust port that is open during one complete cycle of engine operation (the curve 100) and the total area of the intake port that is open during the same cycle of engine operation (the curve 102). The reference is to the exhaust crank angle ("CA") in order to show a representative case where the exhaust crank leads the intake crank, as would be provided when the engine is operated in a uniflow scavenging mode. As per the curve 100, movement of the exhaust piston 20 from its TDC location to its BDC location presents an expansion stroke comprising 0°-180° of engine crankshaft rotation and movement of the exhaust piston from its BDC location to its TDC location following an expansion stroke presents a compression stroke comprising 180°-360° of engine crankshaft rotation. During an expansion stroke, the exhaust port is uncovered first, and pressurized exhaust gas is expelled through the exhaust port. This produces a blow-down event. As can be appreciated with reference to FIG. 4, the exhaust port area opens and closes continuously during the illustrated operational cycle of the baseline configuration, with full opening occurring at BDC)(CA=180°. However, as per FIG. 5, which relates to the reduced-height exhaust port of FIGS. 3A-3C, the curve 100' shows the exhaust port fully opening at a crank angle of about 135° and remaining fully open until a crank angle of about 225°. Of course the range over which the exhaust port is fully open may be varied as may be necessary to achieve other design goals, but is principally influenced by the height $H_P$ of the exhaust port.

Once port height according to the invention is incorporated into the design of a two-stroke, opposed-piston engine for the purpose of reducing cylinder length, other design tradeoffs are possible. For example, If a two-stroke, opposed-piston engine of a given displacement shares equal stroke lengths for the intake and the exhaust pistons, then there is a limit to how short the ports may become before the engine performance suffers. At this limit, the exhaust port shortening relative to the intake port shortening is almost always considerably greater. In a specific case of an engine with 200 mm combined stroke (100 mm intake and 100 mm exhaust), I have found that the shortening of the exhaust port may be on the order of 10 mm-14 mm, while the shortening of the intake port may be on the order of 2 mm-3 mm. The total shortening potential is therefore 12 mm-17 mm. For the same combined stroke of 200 mm, the exhaust stroke may be increased to 120 mm if the intake stroke is reduced to 80 mm. If the same proportions are assumed, the exhaust end of the cylinder may be reduced by 12 mm-16.8 mm, and the intake end may be reduced by 1.6 mm-2.4 mm. The total shortening potential in this example could then be 13.6 mm-19.2 mm. Thus, there is the potential to shorten a two-stroke, opposed-piston engine of a given displacement even further if unequal strokes are applied.

Although principles of ported cylinder and piston constructions have been described with reference to presently preferred embodiments, it should be understood that various modifications can be made without departing from the spirit of the described principles. Accordingly, the patent protection accorded to these principles is limited only by the following claims.

The invention claimed is:

1. A piston and cylinder combination for a two-stroke, opposed-piston engine, comprising:

a cylinder that provides a bore with a longitudinal axis, the cylinder including an exhaust port and an intake port that are spaced-apart and disposed on respective sides of a central portion of the cylinder, the exhaust port having an annular configuration that is orthogonal to the longitudinal axis and that includes an inner edge and an outer edge, the inner edge and the outer edge presenting a port height therebetween, the exhaust port including a plurality of port openings disposed in an annular array along a first respective circumference of the cylinder, and the intake port including a plurality of port openings disposed in an annular array along a second respective circumference of the cylinder; and, first and second pistons placed in opposition in the bore, the first piston disposed for controlling the exhaust port and the second piston disposed for controlling the intake port, each of the first and second pistons including a peripheral edge, an upper ring pack, and a lower ring pack, the upper ring pack and the lower ring pack presenting a separation distance therebetween, the upper ring pack comprising at least a compression ring and the lower ring pack comprises at least an oil scraper ring, each of the first and second pistons being operable to reciprocate between top dead center (TDC) and bottom dead center (BDC) locations in the bore; wherein, when the first piston reaches its TDC location, the exhaust port is between the upper ring pack and the lower ring pack of the first piston, with the lower ring pack adjacent the outer edge of the exhaust port; and, the exhaust port is fully open so as not to be obstructed by the first piston before the first piston reaches its BDC location, wherein during an expansion stroke, the peripheral edge of the first piston reaches the outer edge of the exhaust port before the first piston reaches its BDC location, further wherein:

movement of the first piston from its TDC location to its BDC location presents an expansion stroke comprising 0°-180° of a first engine crankshaft rotation and movement of the first piston from its BDC location to its TDC location following an expansion stroke presents a compression stroke comprising 180°-360° of the first engine crankshaft rotation; and, the exhaust port height causes the exhaust port to remain fully open in a range of about 135° to about 225° of the first crankshaft rotation.

2. The piston and cylinder combination of claim 1, in which the upper and lower ring packs each comprise at least two piston rings.

3. A two-stroke, opposed-piston engine comprising at least one piston and cylinder combination according to any preceding claim.

* * * * *